US009721744B2

(12) United States Patent
Kubota

(10) Patent No.: US 9,721,744 B2
(45) Date of Patent: Aug. 1, 2017

(54) FUSE HOLDER AND FUSE INTERRUPTION MECHANISM

(71) Applicant: Sumitomo Wiring Systems, Ltd., Yokkaichi, Mie (JP)

(72) Inventor: Hidetsugu Kubota, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 141 days.

(21) Appl. No.: 14/429,100

(22) PCT Filed: Apr. 23, 2013

(86) PCT No.: PCT/JP2013/061830
§ 371 (c)(1),
(2) Date: Mar. 18, 2015

(87) PCT Pub. No.: WO2014/061298
PCT Pub. Date: Apr. 24, 2014

(65) Prior Publication Data

US 2015/0228434 A1 Aug. 13, 2015

(30) Foreign Application Priority Data

Oct. 16, 2012 (JP) ..... 2012-228549

(51) Int. Cl.
*H01H 85/143* (2006.01)
*H01H 85/165* (2006.01)
(Continued)

(52) U.S. Cl.
CPC ..... *H01H 85/203* (2013.01); *H01H 85/0208* (2013.01); *H01H 85/2035* (2013.01);
(Continued)

(58) Field of Classification Search
CPC ..... H01H 85/203
(Continued)

(56) References Cited

U.S. PATENT DOCUMENTS 5,277,626 A * 1/1994 Oikawa ..... H01H 85/2035 439/620.27
5,488,345 A 1/1996 Seki et al.
(Continued)

FOREIGN PATENT DOCUMENTS

JP 50-75088 7/1975
JP 5-159693 6/1993
(Continued)

OTHER PUBLICATIONS

International Search Report of May 8, 2013.

*Primary Examiner* — Anthony Haughton
(74) *Attorney, Agent, or Firm* — Gerald E. Hespos; Michael J. Porco; Matthew T. Hespos

(57) ABSTRACT

It is aimed to provide a fuse holder with a novel structure capable of improving insertion operability in the fuse holder for holding a plurality of fuses. A plurality of fuse holding portions (26*a*, 26*b*) are provided into which main body portions (16, 16) of fuses (12*a*, 12*b*) are to be mounted and in which lead portions (14, 14) of the fuses (12*a*, 12*b*) are held in a projecting state. Holding positions of the fuses (12*a*, 12*b*) by the plurality of fuse holding portions (26*a*, 26*b*) are made different from each other in a projecting direction of the lead portions (14) from the main body portions (16) in the fuses (12*a*, 12*b*).

8 Claims, 6 Drawing Sheets

(51) Int. Cl.
*H01H 85/20* (2006.01)
*H01H 85/02* (2006.01)
*H01H 85/54* (2006.01)
*H01H 85/22* (2006.01)

(52) U.S. Cl.
CPC ..... *H01H 85/547* (2013.01); *H01H 85/22* (2013.01); *H01H 2085/208* (2013.01)

(58) Field of Classification Search
USPC ..... 439/620.26, 620.27, 620.29, 620.33, 439/620.34, 374; 337/126, 227, 168, 229, 337/230, 231
See application file for complete search history.

(56) References Cited

U.S. PATENT DOCUMENTS 5,629,663 A 5/1997 Seki et al.
5,680,088 A 10/1997 Seki et al.
6,033,252 A * 3/2000 Hood ..... H01H 85/2035 439/374
6,558,198 B2 * 5/2003 Kobayashi ..... H01H 85/0417 337/290
6,585,541 B2 * 7/2003 Higashida ..... H01H 85/2045 337/186
7,612,646 B2 * 11/2009 Kubota ..... H01H 85/2035 337/186
7,887,372 B2 * 2/2011 Lee ..... H01H 85/0208 439/620.34
2005/0215123 A1 * 9/2005 Saller ..... H01H 85/2035 439/620.27
2010/0060407 A1 * 3/2010 Iwata ..... H01H 69/02 337/227

FOREIGN PATENT DOCUMENTS

JP 7-169382 7/1995
JP 7-192600 7/1995
JP 2001-118487 4/2001

* cited by examiner

FUSE HOLDER AND FUSE INTERRUPTION MECHANISM

BACKGROUND

1. Field of the Invention

The present invention relates to a fuse holder for holding a plurality of fuses and a fuse interruption mechanism using the same.

2. Description of the Related Art

Conventionally, a fuse interruption mechanism using a fuse holder as described, for example, in Japanese Unexamined Patent Publication No. H07-169382 has been provided in an electrical connection box such as a junction box or a fuse box to be installed in an automotive vehicle in some cases. The fuse holder is provided with a plurality of fuse holding portions, so that a plurality of fuses can be held. The fuse holder is mounted to be able to approach and separate from the electrical connection box and the fuses held in the fuse holder are made connectable to and disconnectable from the connection terminals provided in the electrical connection box, whereby the fuse interruption mechanism is configured. Such a fuse interruption mechanism is used to cut off supplied power by temporarily removing the fuses from the connection terminals provided in the electrical connection box for the purpose of preventing the consumption of a battery by so-called dark current circuits, which constantly consume power, such as a clock, a malfunction of an air-bag and the like, for example, in the case of transporting an automotive vehicle a long distance.

When the vehicle is used, the fuse holder is caused to approach the electrical connection box and an inserting operation of connecting the fuses held in the fuse holder to the corresponding connection terminals is performed. However, since the plurality of fuses are simultaneously connected in the fuse holder described in Japanese Unexamined Patent Publication No. H07-169382, a large insertion force is required, which has presented a problem of a large burden on a worker.

The present invention was developed in view of the above situation and an object thereof is to provide a fuse holder with a novel structure capable of improving insertion operability in the fuse holder for holding a plurality of fuses and provide a fuse interruption mechanism with a novel structure using such a fuse holder.

SUMMARY OF THE INVENTION

A first aspect of the present invention relating to a fuse holder is directed to a fuse holder configured such that main body portions of fuses are to be mounted thereinto and including a plurality of fuse holding portions in which lead portions of the fuses are to be held in a projecting state, wherein holding positions of the fuses by the plurality of fuse holding portions are made different from each other in a projecting direction of the lead portions from the main body portions in the fuses.

In the fuse holder structured according to the present invention, the positions of tip edge portions of the lead portions of the fuses held in the respective fuse holding portions are made different from each other in a connecting direction to connection terminals provided in an electrical connection box, which is the projecting direction of the lead portions from the main body portions. This can shift peaks of an insertion force by making timings, at which the lead portions of the respective fuses are connected to the connection terminals arranged at the same height in the electrical connection box, different. As a result, the insertion force required for the connection of the fuses can be reduced and insertion operability can be improved.

Note that the number of the fuse holding portions can be arbitrarily set and three or more fuse holding portions may be provided. Further, in the case of providing three or more fuse holding portions, the fuse holding position by at least one of them has only to be different from those of the others.

According to a second aspect of the present invention relating to the fuse holder, in the fuse holder according to the first aspect, a difference between the positions of tip edge portions of the lead portions of the respective fuses held in the plurality of fuse holding portions is larger than a distance from a press start point where pressing by the lead portion is started at a connection terminal to be connected to the lead portion to a press end point where the pressing by the lead portion is completed.

In this aspect, the press start point of the connection terminal means a pass point of the lead portion where the lead portion of the fuse actually comes into contact with both contact pressure blades and the pressing of the contact pressure blades to expand a spacing therebetween by the lead portion is started when the connection terminal is, for example, a U-shaped so-called tuning fork terminal widely used for the connection of a fuse and formed with a pair of contact pressure blades facing each other. On the other hand, the press end point means a pass point of the lead portion where the pressing of the contact pressure blades to expand the spacing therebetween is completed. The insertion force of the lead portion reaches a peak between the press start point and the press end point and becomes substantially constant after passing through the press end point. Accordingly, it is possible to reliably shift peaks of the insertion force and reduce the insertion force by preventing the lead portion of the other fuse from reaching the press start point while a specific lead portion is located between the press start point and the press end point.

According to a third aspect of the invention relating to the fuse holder, in the fuse holder according to the first or second aspect, the fuse holding portion includes an accommodating portion into which the main body portion of the fuse is inserted and accommodated in a direction perpendicular to the projecting direction of the lead portion and a lock means for holding the main body portion in a state accommodated in the accommodating portion by locking the main body portion in the direction perpendicular to the projecting direction of the lead portion.

In this aspect, the fuse is inserted into the fuse holding portion in a horizontal direction (direction perpendicular to the projecting direction of the lead portion) and an engagement force of the lock means is applied in the horizontal direction. This can eliminate a need to ensure an insertion/withdrawal force of the lead portion into/from the connection terminal by a holding force of the lock means unlike in the case of locking in a vertical direction (projecting direction of the lead portion), the lock means can be made small and simple, and a force required to mount the fuse into the fuse holder can be reduced. Further, since the fuse holding position can be accurately set in the projecting direction of the lead portion by inserting the fuse in the horizontal direction, the position of the tip edge portion of the lead portion can be accurately set for each fuse.

According to a fourth aspect of the present invention relating to the fuse holder, in the fuse holder according to any one of the first to third aspects, the fuse holder includes a guide portion for guiding the fuse holder to an electrical connection box, in which connection terminals to be connected to the lead portions of the fuses are provided, movably in the projecting direction of the lead portions, and a temporarily holding portion for positioning and temporarily holding the lead portions in a state unconnected to the connection terminals by being locked to the electrical connection box.

According to this aspect, the fuse holder can be locked to the electrical connection box by the temporarily holding portion and the fuses can be mounted in the electrical connection box via the fuse holder while being removed from the connection terminals. This makes it possible to prevent the fuses removed from the connection terminals from being lost, connect the fuses only by pushing the fuse holder mounted in the electrical connection box in advance in a guiding direction of the guide portion, and facilitate a connecting operation.

The present invention relating to a fuse interruption mechanism is directed to a fuse interruption mechanism in which a fuse holder holding a plurality of fuses is mounted to be able to approach/separate from an electrical connection box including a fuse connection circuit accommodated therein, and lead portions of the plurality of fuses are connected/disconnected to/from a plurality of connection terminals of the fuse connection circuit by causing the fuse holder to approach/separate from the electrical connection box, wherein the plurality of connection terminals of the fuse connection circuit are arranged at the same height position in an approaching/separating direction of the fuse holder, and the fuse holder according to any one of the first to fourth aspects is used as the fuse holder.

According to such a fuse interruption mechanism, the plurality of fuses held in the fuse holder can be connected and disconnected to and from the connection terminals provided in the electrical connection box at once by causing the fuse holder to approach and separate from the electrical connection box. Further, by mounting the fuse holder into the electrical connection box, the fuses disconnected from the connection terminals can be mounted in the electrical connection box via the fuse holder and the loss of the fuses can also be prevented. By using the fuse holder according to any one of the first to fourth aspects relating to the fuse holder as the fuse holder, it is possible to reduce an insertion force of inserting the plurality of fuses into the plurality of connection terminals arranged at the same height position in an inserting/withdrawing direction of the lead portions and facilitate a connecting operation. In this way, the fuses can be easily connected to and disconnected from a dark current circuit, an air-bag circuit or the like from which the fuses are temporarily removed, for example, during long-distance transportation.

In the present invention relating to the fuse holder and the fuse interruption mechanism, the fuse holding positions by the plurality of fuse holding portions in the fuse holder are made different from each other in the projecting direction of the lead portions of the fuses. In this way, it is possible to make timings, at which the lead portions of the fuses are connected to the connection terminals, different and shift peaks of the insertion force. As a result, insertion operability can be improved by reducing the insertion force.

DETAILED DESCRIPTION

Hereinafter, embodiments of the present invention are described with reference to the drawings.

Figure 1:
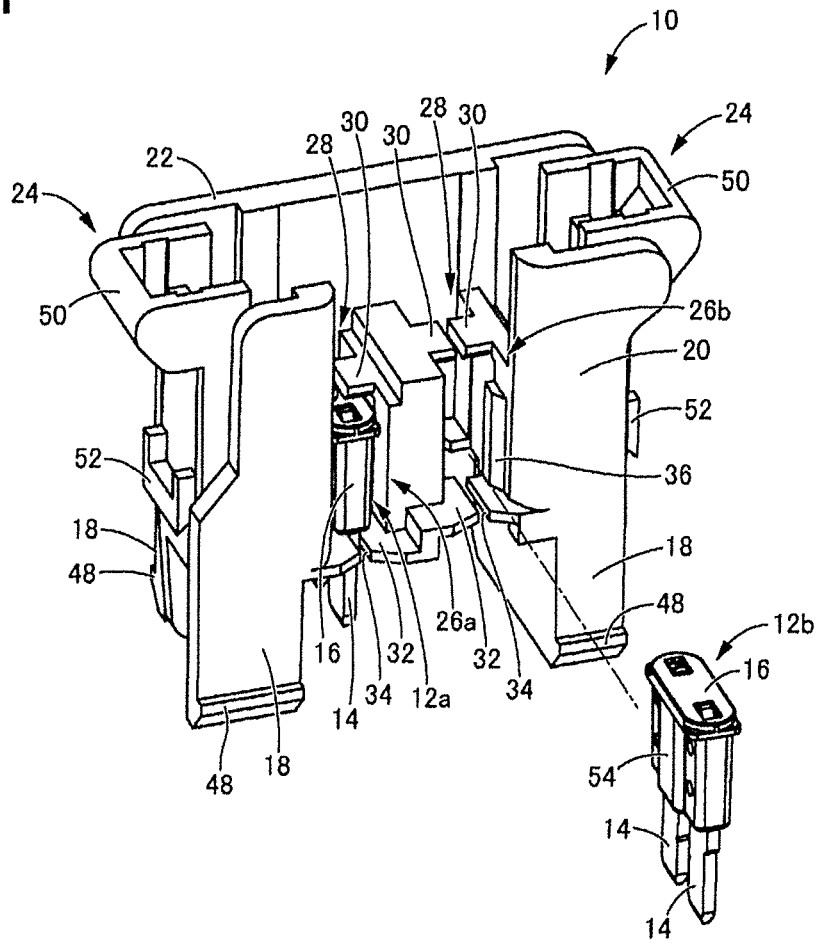
FIG. 1 is a perspective view of a fuse holder as one embodiment of the present invention and fuses.
Figure 2:
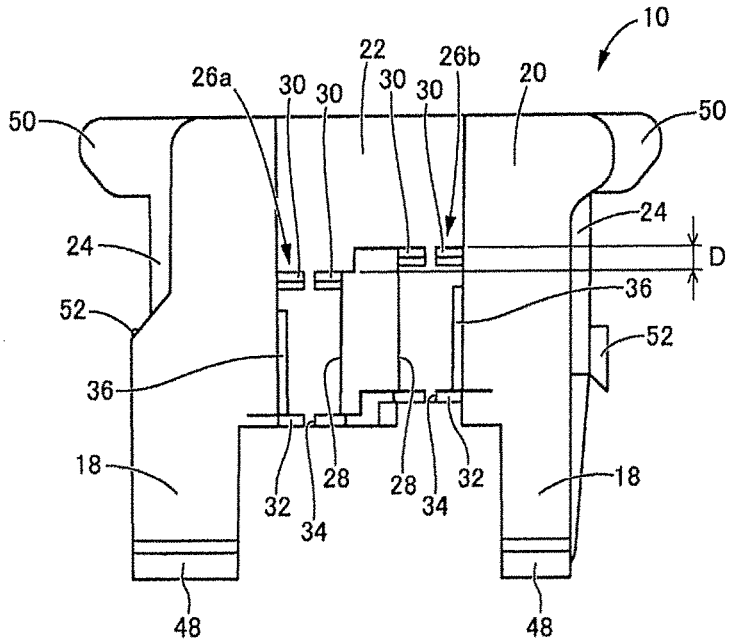
FIG. 2 is a front view of the fuse holder shown in FIG. 1.
Figure 3:
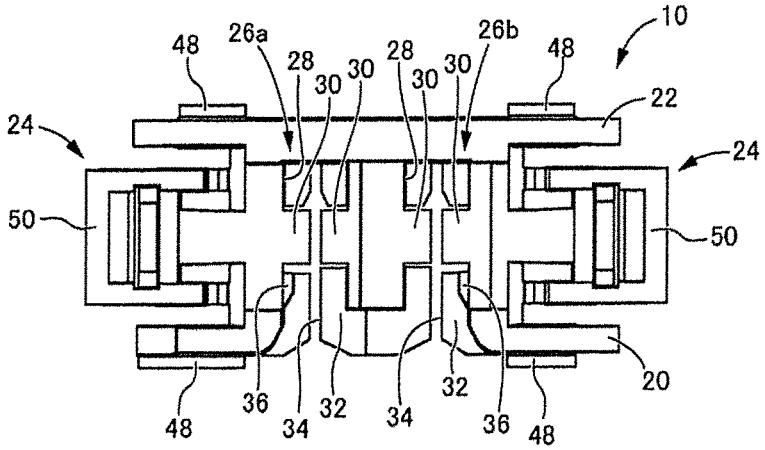
FIG. 3 is a top view of the fuse holder shown in FIG. 1.

First, FIG. 1 shows a fuse holder 10 as one embodiment of the present invention relating to a fuse holder and fuses 12*a*, 12*b* to be mounted into the fuse holder 10 together, and FIGS. 2 and 3 show the fuse holder 10. The fuses 12*a*, 12*b* are the same members, conventionally widely used and structured such that a pair of lead portions 14, 14 project from a main body portion 16 substantially in the form of a rectangular block. In the following description, a vertical direction is the one in FIG. 2 in which the lead portions 14, 14 of the fuses 12*a*, 12*b* are inserted into and withdrawn from connection terminals 38 to be described later unless otherwise specified.

The fuse holder 10 is an integrally molded article made of synthetic resin. When viewed from front (see FIG. 2), the fuse holder 10 has a gate shape in which a pair of guide portions 18, 18 project. In the fuse holder 10, a front plate portion 20 and a rear plate portion 22 are formed to face each other and a pair of resilient piece portions 24, 24 are formed between the front plate portion 20 and the rear plate portion 22.

Two fuse holding portions 26*a*, 26*b* are formed in a central part of the fuse holder 10. Since the fuse holding portions 26*a*, 26*b* are structured to be substantially similar to each other, the fuse holding portion 26*a* is described below, components of the fuse holding portion 26*b* are denoted by reference signs similar to those for the fuse holding portion 26*a* in the drawings and the fuse holding portion 26*b* is not described.

The fuse holding portion 26*a* is formed with an accommodating portion 28 which is open on the front plate portion 20. The accommodating portion 28 is a rectangular hollow space of a size corresponding to the main body portion 16 of the fuse 12*a* and extends between the front plate portion 20 and the rear plate portion 22. Upper walls 30, 30 are formed on an upper end edge part of the accommodating portion 28. The upper walls 30, 30 are in the form of plates projecting in directions toward each other from central parts of inner surfaces extending in a longitudinal direction (vertical direction in FIG. 3) in the accommodating portion 28, and formed to face each other while being spaced apart. On the other hand, a lower wall 32 formed on a lower end edge part of the accommodating portion 28 is formed with a slit 34 extending in the longitudinal direction of the accommodating portion 28, and one end edge of the slit 34 is open on an outer peripheral edge part of the lower wall 32 near the front plate portion 20.

A lock claw 36 as a lock means is formed on the inner surface of the accommodating portion 28. The lock claw 36 is formed on an end part of the inner surface on the side of the front plate portion 20 located at an outer side in the accommodating portion 28 of each of the fuse holding portions 26*a*, 26*b*. The lock claw 36 extends a predetermined length from the lower wall 32 toward the upper wall 30 and a projecting distance from the inner surface of the accommodating portion 28 is gradually increased from the side of the front plate portion 20 toward the rear plate portion 22.

Such fuse holding portions 26*a*, 26*b* are formed at positions shifted from each other in the vertical direction. In this embodiment, the fuse holding portion 26*a* is formed to be lower than the fuse holding portion 26*b*. As shown in FIG. 2, a difference D between the positions of the fuse holding portions 26*a*, 26*b* in the vertical direction is larger than a distance d from press start points 40 to press end points 42 on the connection terminals 38 shown in FIG. 4 to which the lead portions 14 of the fuses 12*a*, 12*b* are connected and which are provided in an electrical connection box 62 to be described later.

The connection terminals 38 have been conventionally widely used as connection terminals for the fuses 12*a*, 12*b* and have a U-shaped so-called tuning fork shape in which a pair of contact pressure blades 44, 44 are formed to face each other. Holding protrusions 46, 46 having a substantially semi-circular cross-section and projecting in directions toward each other are integrally formed on tip edge parts of the contact pressure blades 44, 44. Positions on tip sides of the contact pressure blades 44, 44 (upper side in FIG. 4) where a facing distance of the holding protrusions 46, 46 is equal to a thickness t of the lead portion 14 are the press start points 40, 40, whereas positions where the facing distance of the holding protrusions 46, 46 is a shortest distance S2 are the press end points 42.

Figure 4A:
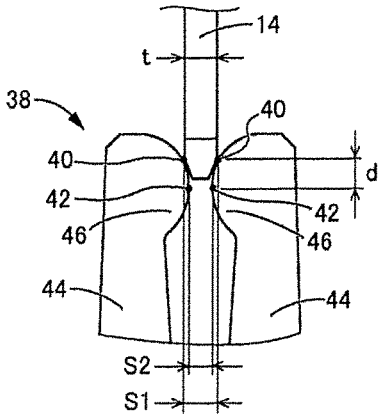
FIG. 4 are diagrams showing press start points and press end points of a connection terminal.
Figure 4B:
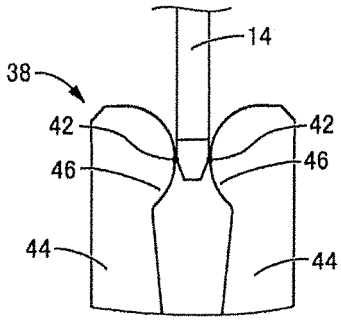

A pressing force of pressing the contact pressure blades 44, 44 in directions away from each other to expand a spacing therebetween is applied to such a connection terminal 38 when the lead portion 14 comes into contact with the press start points 40, 40 as shown in FIG. 4(*a*). When the lead portion 14 passes over the press end points 42, 42 as shown in FIG. 4(*b*), the pressing of the contact pressure blades 44, 44 to expand the spacing therebetween is completed. Accordingly, an insertion force of inserting the fuse 12 into the connection terminal 38 increases when the lead portion 14 reaches the press start points 40, 40 and the pressing of the contact pressure blades 44, 44 to expand the spacing therebetween is started, becomes a force of a substantially constant magnitude based on frictional forces with the holding protrusions 46, 46 after the lead portion 14 reaches the press end points 42, 42 and the pressing of the contact pressure blades 44, 44 to expand the spacing therebetween is completed, and reaches a maximum peak until the lead portion 14 reaches the press end points 42, 42 after reaching the press start points 40, 40. The difference D (see FIG. 2) between the positions of the fuse holding portions 26*a*, 26*b* in the vertical direction is set to be larger than the distance d from the press start points 40 to the press end points 42 on the connection terminals 38.

Further, the front plate portion 20 and the rear plate portion 22 of the fuse holder 10 are formed with the pair of guide portions 18, 18 projecting downwardly at opposite sides of the fuse holding portions 26*a*, 26*b*. Detachment preventing claws 48 projecting outwardly in a facing direction (vertical direction in FIG. 3) of the front plate portion 20 and the rear plate portion 22 are formed on downwardly projecting end edge parts of these guide portions 18.

Further, resilient piece portions 24, 24 are integrally formed at the opposite sides of the fuse holding portions 26*a*, 26*b* between the facing surfaces of the front plate portion 20 and the rear plate portion 22. The resilient piece portions 24, 24 are coupled at lower end parts to the front plate portion 20 and the rear plate portion 22, while being in an uncoupled state at upper end parts by being separated from the front plate portion 20 and the rear plate portion 22. This enables the upper end parts of the resilient piece portions 24, 24 to be resiliently deformed inwardly of the fuse holder 10 with the lower end parts as supporting points. Note that operating protrusions 50, 50 projecting outwardly in a width direction (lateral direction in FIG. 2) of the front plate portion 20 and the rear plate portion 22 are formed on the upper end parts of the resilient piece portions 24, 24 so that the resilient piece portions 24, 24 are easily deformed inwardly of the fuse holder 10. In the fuse holder 10, temporarily holding claws 52, 52 as temporarily holding portions are formed on outer surfaces of the resilient piece portions 24, 24, which form side surfaces between the front plate portion 20 and the rear plate portion 22.

Figure 5:
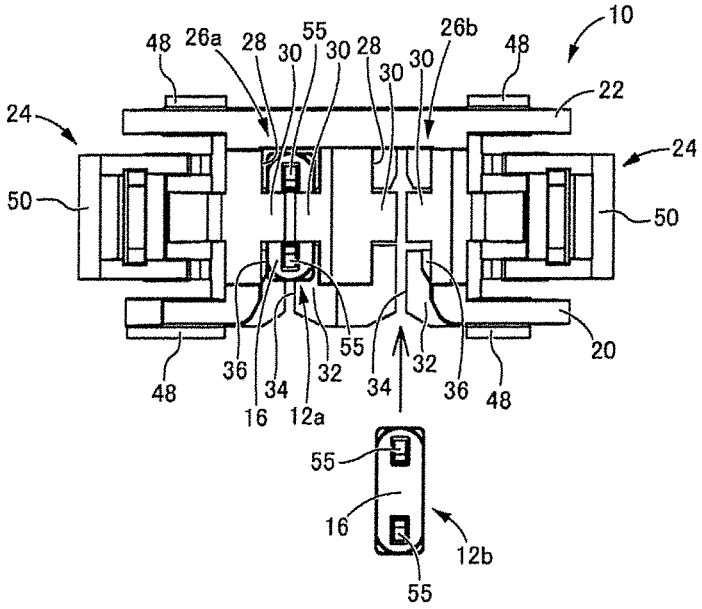
FIG. 5 is a top view showing how to mount the fuse into the fuse holder shown in FIG. 1.

As shown in FIG. 1, the fuses 12*a*, 12*b* are mounted into the fuse holding portions 26*a*, 26*b* of such a fuse holder 10. As also shown in FIG. 5, the main body portion 16 of each of these fuses 12*a*, 12*b* is inserted into the accommodating portion 28 of the fuse holding portion 26 in a horizontal direction (longitudinal direction) perpendicular to the projecting direction of the lead portions 14, 14. The main body portion 16 is vertically sandwiched by the upper walls 30 and the lower wall 32 of the accommodating portion 28 and inserted in a lightly press-fitted state. Further, the lead portions 14, 14 are inserted into the slit 34. A central protrusion 54 (see FIG. 1) formed on a longitudinal central part of the main body portion 16 moves over the lock claw 36 and is locked in the horizontal direction by the lock claw 36, whereby the main body portion 16 is mounted into the fuse holder 10 while being accommodated in the accommodating portion 28. In this way, the fuses 12*a*, 12*b* are respectively held in the fuse holding portions 26*a*, 26*b*.

Particularly in this embodiment, the upper walls 30, 30 of the accommodating portions 28 are formed only in central parts of the accommodating portions 28 in the longitudinal direction (vertical direction in FIG. 5) and only central parts of the fuses 12*a*, 12*b* accommodated in the accommodating portions 28 in the longitudinal direction (vertical direction in FIG. 5) are covered. This can prevent conduction inspection terminals 55, 55 exposed at opposite longitudinal end parts of the main body portion 16 from being covered by the upper walls 30, 30, and terminals of an unillustrated inspection device can be inserted from above to facilitate conduction inspection. However, the shape of the upper walls 30, 30 is not limited to that of this embodiment and a single plate for covering the entire surface of the main body portion 16 may be, for example, used.

Figure 6:
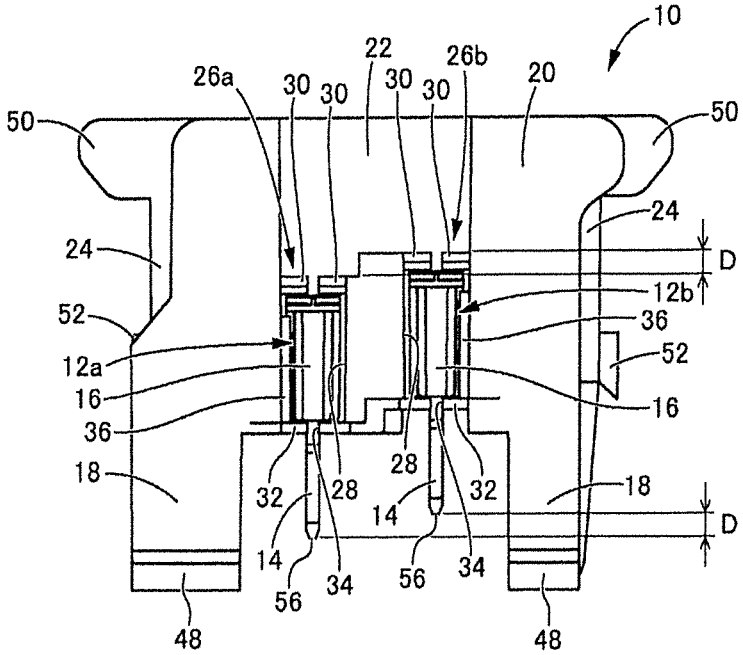
FIG. 6 is a front view showing a fuse mounted state of the fuse holder shown in FIG. 1.

As shown in FIG. 6, the main body portions 16 of the fuses 12*a*, 12*b* are held in the fuse holding portions 26*a*, 26*b*, held in contact with the upper walls 30 and the lower walls 32 and accommodated in the accommodating portions 28 while being positioned in the vertical direction. On the other hand, the lead portions 14, 14 project downwardly of the fuse holder 10 through the slits 34. The positions of the fuses 12*a*, 12*b* held in the fuse holding portions 26*a*, 26*b* are made different by the distance D in the vertical direction and the positions of tip edge portions 56, 56 of the lead portions 14, 14 of the fuses 12*a*, 12*b* are made different by the distance D in the vertical direction by making the positions of the fuse holding portions 26*a*, 26*b* different by the distance D in the vertical direction, which is the projecting direction of the lead portions 14 and a connecting direction of the fuses 12*a*, 12*b* to the connection terminals 38.

Figure 7A:
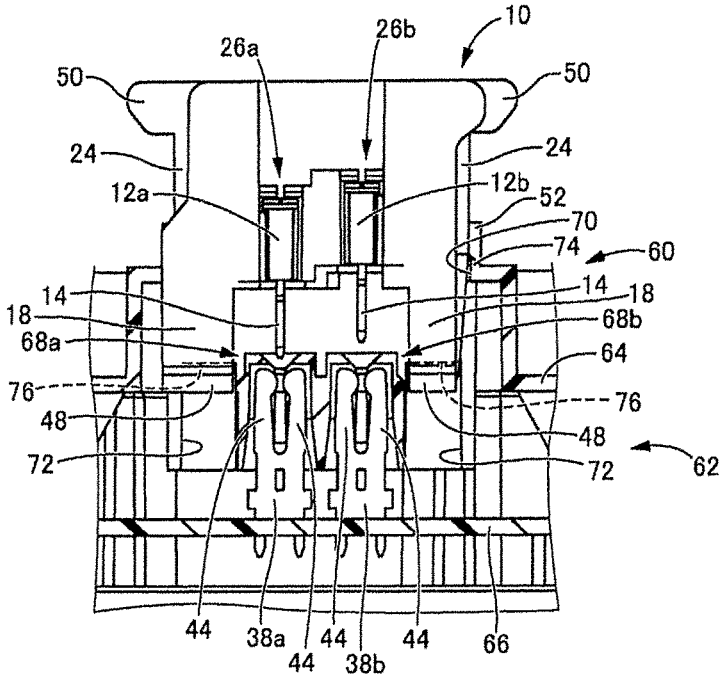
FIG. 7 are sections showing a fuse interruption mechanism as one embodiment of the present invention.
Figure 7B:
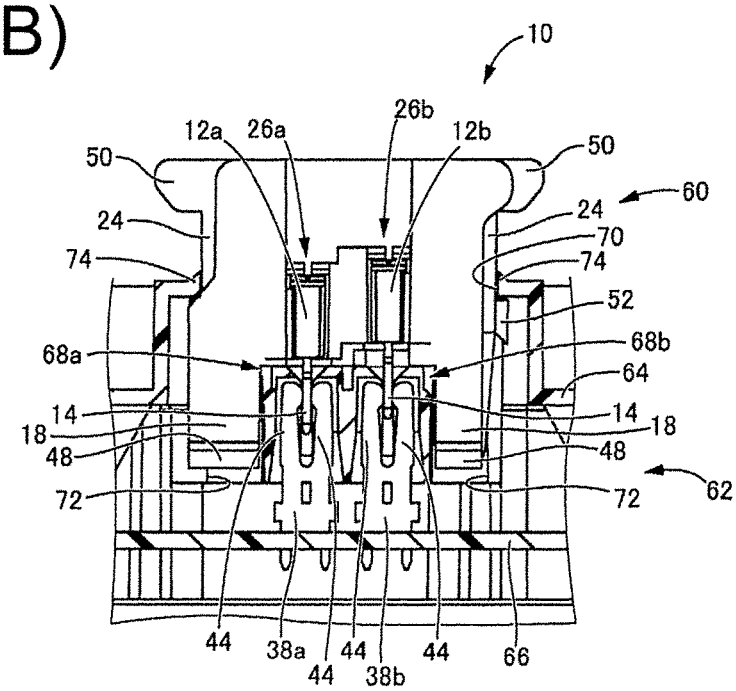

FIG. 7 show the electrical connection box 62 provided with a fuse interruption mechanism 60 as one embodiment of the present invention relating to a fuse interruption mechanism. The electrical connection box 62 is, for example, a junction box or a fuse box and a printed board 66 as a fuse connection circuit is accommodated in a case 64. A plurality of (only two are shown in FIG. 7) of connection terminals 38*a*, 38*b* are soldered to project from the printed board 66. The contact pressure blades 44, 44 of the connection terminals 38*a*, 38*b* are accommodated in fuse mounting portions 68*a*, 68*b* formed in the case 64. The connection terminals 38*a*, 38*b* are the same members and arranged such that the contact pressure blades 44 of the connection terminal 38*a* and those of the connection terminal 38*b* are at the same height position in a moving direction of the fuse holder 10 (approaching/separating direction of the fuse holder 10, vertical direction in FIG. 7).

Further, a holder insertion hole 70 is provided above the fuse mounting portions 68*a*, 68*b* in the case 64. In the holder insertion hole 70, guide holes 72, 72 formed into rectangular holes extending in the vertical direction, which is a projecting direction of the contact pressure blades 44 of the connection terminals 38*a*, 38*b*, are formed at opposite sides of the fuse mounting portions 68*a*, 68*b*. Further, temporarily holding projections 74, 74 projecting upwardly are formed on opening edge parts of the holder insertion hole 70 at the opposite sides of the fuse mounting portions 68*a*, 68*b*.

As shown in FIG. 7(*a*), the fuse holder 10 shown in the above embodiment is inserted into the holder insertion hole 70 with the guide portions 18 in the lead while holding the fuses 12*a*, 12*b*, and the detachment preventing claws 48 of the guide portions 18 are inserted into the guide holes 72. Note that although only the guide holes 72 into which the detachment preventing claws 48, 48 (only one is shown in FIG. 1) of the pair of guide portions 18, 18 provided on the rear plate portion 22 are shown in FIG. 7, the detachment preventing claws 48, 48 provided on the front plate portion 20 are also inserted into similar guide holes 72. In this way, the fuse holder 10 are guided by the detachment preventing claws 48 and the guide holes 72 and able to approach and separate from the electrical connection box 62 in the projecting direction of the lead portions 14. Further, when the fuse holder 10 is moved in the direction to separate from the electrical connection box 62, the detachment preventing claws 48 are locked to upper end edge parts of the guide holes 72, thereby preventing the detachment of the fuse holder 10 from the electrical connection box 62. Then, the temporarily holding claws 52, 52 provided on the resilient piece portions 24, 24 of the fuse holder 10 are locked to the temporarily holding projections 74, 74 of the case 64, thereby preventing a displacement of the fuse holder 10 in the direction to approach the electrical connection box 62. In this way, the fuse holder 10 is mounted into the electrical connection box 62 while being positioned at a temporary holding position shown in FIG. 7(*a*). At the temporary holding position of the fuse holder 10, the lead portions 14, 14 of the fuses 12*a*, 12*b* held in the fuse holder 10 are both temporarily held without being connected to the connection terminals 38*a*, 38*b*.

Then, the operating protrusions 24, 24 of the fuse holder 10 are pressed inwardly of the fuse holder 10 to resiliently deform the resilient piece portions 24, 24 inwardly of the fuse holder 10, whereby the temporarily holding claws 52, 52 are disengaged from the temporarily holding projections 74, 74 and enabled to pass through the holder insertion hole 70 by being inserted into the fuse holder 10. Then, the fuse holder 10 is caused to approach the electrical connection box 62 while being guided by the detachment preventing claws 48 and the guide holes 72, thereby being located at a connection position shown in FIG. 7(*b*). In this way, the lead portions 14, 14 of the fuses 12*a*, 12*b* held in the fuse holder 10 are respectively connected to the connection terminals 38*a*, 38*b*.

Further, the fuse holder 10 located at the connection position shown in FIG. 7(*b*) is separated from the electrical connection box 62 while being guided by the detachment preventing claws 48 and the guide holes 72 in a state where the operating protrusions 50, 50 are pressed inwardly of the fuse holder 10 and the temporarily holding claws 52, 52 are enabled to pass through the holder insertion hole 70, whereby the lead portions 14, 14 of the fuses 12*a*, 12*b* are separated from the connection terminals 38*a*, 38*b* and the fuse holder 10 can be returned to the temporary holding position shown in FIG. 7(*a*).

Figure 8:
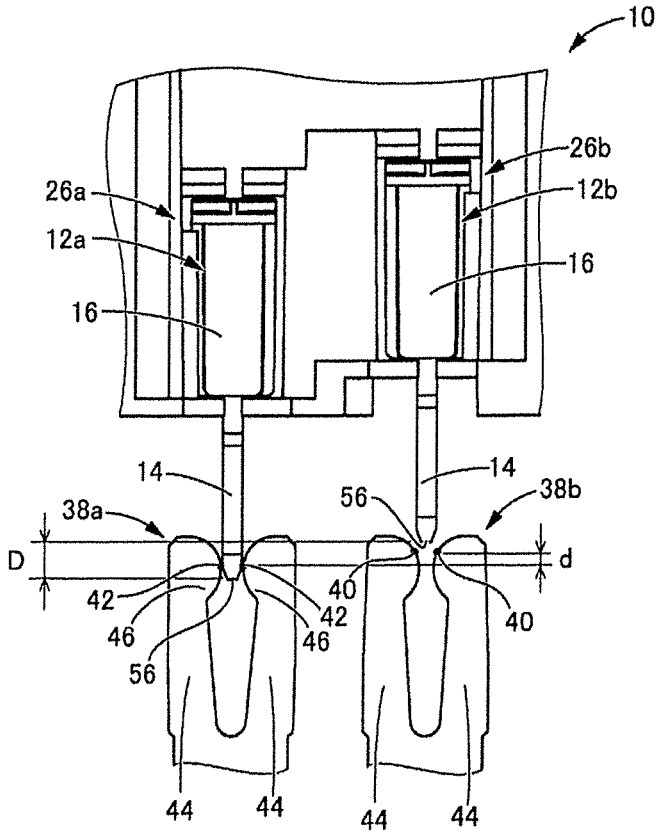
FIG. 8 is a diagram showing a state where the fuses held in the fuse holder shown in FIG. 7 are being connected.

In the fuse holder 10 in this embodiment, the holding position of the fuse 12*a* by the fuse holding portion 26*a* is located before (closer to the connection terminal 38) that of the fuse 12*b* by the fuse holding portion 26*b* in the projecting direction of the lead portions 14, i.e. in the connecting direction of the fuses 12*a*, 12*b* to the connection terminals 38*a*, 38*b*. Thus, when the fuse holder 10 is caused to approach the electrical connection box 62, the lead portions 14 of the fuse 12*a* are connected to the corresponding connection terminal 38*a* earlier than the lead portions 14 of the fuse 12*b* as shown in FIG. 8. Particularly in this embodiment, the difference D between the position of the tip edge portions 56 of the lead portions 14 of the fuse 12*a* and that of the tip edge portions 56 of the lead portions 14 of the fuse 12*b* in the projecting direction of the lead portions 14 is larger than the distance d from the press start points 40 to the press end points 42 on the connection terminals 38 in the connecting direction of the lead portions 14 to the connection terminals 38. Thus, the connection of the fuse 12*b* to the connection terminal 38*b* is not started until the lead portions 14 of the fuse 12*a* pass through the press end points 42 of the connection terminal 38*a*. This can shift the timings of peaks of an insertion force of inserting the respective fuses 12*a*, 12*b* into the connection terminals 38*a*, 38*b* and enables the connecting operation of the fuses 12*a*, 12*b* to be performed with a smaller insertion force.

Further, the main body portions 16, 16 of the fuses 12*a*, 12*b* are inserted into the accommodating portions 28, 28 of the fuse holding portions 26*a*, 26*b* in the horizontal direction perpendicular to the projecting direction of the lead portions 14. This enables the main body portions 16 to be accurately positioned in the vertical direction by being sandwiched between the upper walls 30 and the lower walls 32 of the accommodating portions 28. Further, by the contact of the upper walls 30 and the lower walls 32 with the main body portions 16, holding forces for the fuses 12*a*, 12*b* at the time of insertion into and withdrawal from the connection terminals 38*a*, 38*b* are ensured. Thus, a lock means for holding the fuses 12*a*, 12*b* can be configured by the small-sized and simple lock claws 36 and forces required to mount the fuses 12*a*, 12*b* into the fuse holder 10 can also be reduced.

Although the embodiments of the present invention have been described above, the present invention is not limited to the specific description thereof. For example, the number of the fuse holding portions may be set at three or more. In such a case, the fuse holding position by at least one fuse holding portion has only to be different from those of the other fuse holding portions.

Further, the specific shape of the fuse holder described in the above embodiment is merely an example and the specific shape of the fuse holder of the present invention is not limited to this. For example, the mounting direction of the fuses into the fuse holder is not limited to the horizontal direction as described in the above embodiment and the fuses may be inserted and mounted into the fuse holder in the vertical direction (connecting direction of the fuses to the connection terminals). Further, the specific shapes of the guide portions 18 and the resilient piece portions 24 in the above embodiment can also be appropriately changed. Furthermore, the guide portions and the temporarily holding portions are not necessarily required and the use of the present invention is not limited to the fuse holder to be mounted into the electrical connection box.

LIST OF REFERENCE SIGNS

10: fuse holder, 12*a*, 12*b*: fuse, 14: lead portion, 16: main body portion, 18: guide portion, 26*a*, 26*b*: fuse holding portion, 28: accommodating portion, 36: lock claw (lock means), 38: connection terminal, 40: press start point, 42: press end point, 52: temporarily holding claw (temporarily holding portion), 56: tip edge portion (lead portion), 60: fuse interruption mechanism, 62: electrical connection box, 66: printed board (fuse connection circuit), 68*a*, 68*b*: fuse mounting portion, 72: guide hole

The invention claimed is:

1. A fuse holder configured for holding at least first and second fuses, each of the fuses having a main body and leads projecting from the main body in a projecting direction, the fuse holder comprising:

at least first and second fuse holding portions configured respectively for holding the first and second fuses, the first fuse holding portion being at a different holding position than the second fuse holding portion so that the leads of the first fuse project farther from the fuse holder in the projecting direction than the leads of the second fuses.

2. The fuse holder of claim 1, wherein each of the fuse holding portions includes an accommodating portion into which the main body of the respective fuse is inserted and accommodated in a direction perpendicular to the projecting direction of the leads and a lock means for holding the main body in a state accommodated in the accommodating portion by locking the main body in the direction perpendicular to the projecting direction of the leads.

3. The fuse holder of claim 1, comprising:

a guide portion for movably guiding the fuse holder in the projecting direction of the leads and to an electrical connection box, in which connection terminals to be connected to the leads of the fuses are provided; and a temporarily holding portion for positioning and temporarily holding the lead in a state unconnected to the connection terminals by being locked to the electrical connection box.

4. A fuse interruption mechanism, comprising:

an electrical connection box including a fuse connection circuit accommodated therein, the fuse connection circuit having a plurality of connection terminals arranged at the same height position in an approaching/separating direction; and a fuse holder having at least first and second fuse holding portions configured for holding at least first and second fuses, each of the fuses having a main body and leads projecting from the respective main body, the fuses being held in the fuse holder so that the leads are alignable along the approaching/separating direction for connection with the connection terminals, and the first fuse holding portion being at a different holding position than the second fuse holding portion so that the leads of the first fuse project farther from the fuse holder along the approaching/separating direction than the leads of the second fuse and so that the leads of the first fuse engage the connection terminals before the leads of the second fuse.

5. The fuse interruption mechanism of claim 4, wherein a difference between positions of tips of the leads of the respective fuses held in the fuse holding portions is larger than a distance from a press start point where pressing by the lead is started at the connection terminal to be connected to the lead to a press end point where the pressing by the lead is completed.

6. The fuse interruption mechanism of claim 5, wherein each of the fuse holding portions includes an accommodating portion into which the main body of the respective fuse is inserted and accommodated in a direction perpendicular to the projecting direction of the leads and a lock means for holding the main body in a state accommodated in the accommodating portion by locking the main body in the direction perpendicular to the projecting direction of the leads.

7. The fuse interruption mechanism of claim 6, comprising:

a guide portion for movably guiding the fuse holder in the projecting direction of the leads and to the electrical connection box, in which the connection terminals to be connected to the leads of the fuses are provided; and a temporarily holding portion for positioning and temporarily holding the leads in a state unconnected to the connection terminals by being locked to the electrical connection box.

8. The fuse interruption mechanism of claim 4, comprising:

a guide portion for movably guiding the fuse holder in the projecting direction of the leads and to the electrical connection box, in which the connection terminals to be connected to the leads of the fuses are provided; and a temporarily holding portion for positioning and temporarily holding the leads in a state unconnected to the connection terminals by being locked to the electrical connection box.

* * * * *